US006073423A

United States Patent [19]

House et al.

[11] Patent Number: 6,073,423

[45] Date of Patent: Jun. 13, 2000

[54] METHODS AND APPARATUS FOR ERECTING TUBULAR CARTON BLANKS

[75] Inventors: Andrew House; Charles A. Mosse; Richard W. E. Mosse, all of London, United Kingdom

[73] Assignee: Tetra Laval Holdings & Finance S.A., Pully, Switzerland

[21] Appl. No.: 08/904,845

[22] Filed: Aug. 1, 1997

Related U.S. Application Data

[63] Continuation of application No. PCT/GB96/00223, Feb. 2, 1996.

[51] Int. Cl.[7] ..... B65B 43/30

[52] U.S. Cl. ..... 53/564; 53/579; 493/313; 493/315; 493/316; 493/317

[58] Field of Search ..... 53/564, 565, 566, 53/578, 579; 493/313, 315, 316, 317, 318, 319

[56] References Cited

U.S. PATENT DOCUMENTS

| | | | |
|---|---|---|---|
| 2,671,385 | 3/1954 | Johenning et al. | 493/319 X |
| 2,757,498 | 8/1956 | Meyer-Jagenberg et al. | 493/309 X |
| 2,984,162 | 5/1961 | Gordon . | |
| 3,058,271 | 10/1962 | McGihon | 493/309 X |
| 3,060,654 | 10/1962 | Lubersky et al. | 493/313 X |
| 3,242,827 | 3/1966 | Winters | 493/315 |
| 3,937,131 | 2/1976 | Kellogg . | |
| 3,937,458 | 2/1976 | Langen . | |
| 4,642,945 | 2/1987 | Langen et al. . | |
| 4,685,275 | 8/1987 | Nigrelli | 493/319 X |
| 4,735,600 | 4/1988 | Drewke et al. | 493/315 X |
| 4,881,934 | 11/1989 | Harston et al. | 493/315 |
| 4,994,011 | 2/1991 | Reil . | |
| 5,102,385 | 4/1992 | Calvert | 493/315 |
| 5,155,968 | 10/1992 | Mosse et al. | 493/315 X |
| 5,215,515 | 6/1993 | Bershadsky | 493/315 |
| 5,415,615 | 5/1995 | Culpepper | 493/315 |
| 5,426,920 | 6/1995 | Quadalti | 53/564 |
| 5,473,868 | 12/1995 | Martelli | 493/313 X |
| 5,488,812 | 2/1996 | Stark et al. | 53/556 X |
| 5,562,581 | 10/1996 | Roberto et al. | 493/317 X |

FOREIGN PATENT DOCUMENTS

| | | |
|---|---|---|
| 2 053 133 | 2/1981 | United Kingdom . |
| 95 02539 | 1/1995 | WIPO . |
| 96/23655 | 8/1996 | WIPO . |

*Primary Examiner*—Daniel B. Moon
*Attorney, Agent, or Firm*—Pillsbury Madison & Sutro, LLP

[57] ABSTRACT

Apparatus for loading carton blanks into a packing machine comprises a magazine containing a stack of flattened, tubular blanks, a dog chain driving the blanks out of the magazine into the nip of rollers and then into the nip of overdriven rollers which accelerate the blanks into respective pockets defined in transport holders carried on a wheel conveyor. The blanks are driven at a speed sufficient to carry them into their respective pockets which are moving away from the magazine on the wheel conveyor. A slipping clutch in the drive to roller allows the blanks to decelerate without damage when fully home in their pockets. Arms bearing suction heads travelling with the wheel conveyor open the carton blanks in the pockets and the opened blanks are transferred in their transport holders for bottom closing, filling and top closing operations on respective wheel conveyors.

24 Claims, 8 Drawing Sheets

METHODS AND APPARATUS FOR ERECTING TUBULAR CARTON BLANKS

This is a Continuation of: International Appln. No. PCT/GB96/00223 filed Feb. 2, 1996 which designated the U.S.

BACKGROUND OF THE INVENTION

1. Field of the Invention

The present invention relates to methods and apparatus for erecting tubular carton blanks from a flattened configuration to an open tubular configuration.

2. Description of the Related Art

Machines for packing solid articles or for packing liquids are often designed to be fed with a supply of carton blanks in an open tubular configuration. During the packing operation, a bottom closure is formed, the blank is filled with the appropriate contents and a top closure is formed to produce a filled box. The tubular blanks are generally supplied to the machine in flattened form from a magazine containing a stack of such flattened blanks. The blanks must be removed one by one from the magazine and must be erected into an open tubular configuration for packing as described above. Numerous proposals have been made in the past for carrying out the steps of removing the flattened blanks from the magazine and opening them whilst positioning them in a packing machine for filling and closing. In EP-A-0425226, blanks are removed at the mouth of a magazine by a transfer wheel which has several similar transfer arms. Each arm has a hook to engage the trailing edge of a blank at the magazine mouth and to drive the magazine sideways out of the mouth whilst the face of the blank is engaged by a suction head which grips the blank. After the rotating arm clears the magazine, the hook is rotated round with respect to the suction head forcing the blank to open by hinging movement of panels of the blank with respect to one another about a line joining respective panels which lies between the suction head and the hook. The opened blank is carried round on the transfer arm to a conveyor having a succession of pockets and the opened blank is deposited into a respective pocket on the conveyor.

This effectively restricts the orientation of the openings of the pockets to facing out from their conveyor, but in some circumstances it is desirable for the cartons to be in pockets in which the openings face forwards or backwards along the direction of movement of the conveyor.

Broadly similar arrangements for extracting blanks from a magazine, opening them and depositing them on a moving conveyor for further handling are described in numerous other specifications such as GB-A-2053133. In all of these previously described arrangements, the carton blanks are delivered into the conveyor pockets in an erected state.

An alternative scheme is shown in U.S. Pat. No. 3,937,458 and used also in U.S. Pat. No. 4,642,975. Here, blanks are withdrawn from the mouth of a magazine by a suction cup which is driven by an epicyclic gear mechanism to move over an approximately triangular path, one apex of which coincides with the magazine and a second apex of which coincides with the path of a pocket conveyor into which articles drawn from the magazine are to be dropped. It is disclosed that by arranging for the blanks withdrawn from the magazine to contact a suitable striker carried by the conveyor mechanism, the blanks may be forced to open as they are deposited into a pocket on the conveyor.

In the arrangement described, it will be difficult to operate at any substantial speed because the blank is removed out of the magazine after attachment to a suction cup which where it contacts the lead blank in the magazine, is undergoing virtually a reciprocating movement. Also, the erection of the blank depends upon contact between the blank and the moving conveyor. The speed of the apparatus is therefore limited by the speed at which one can open a carton blank in this manner without damage.

BRIEF SUMMARY OF THE INVENTION

The present invention relates to a number of modifications and improvements to such previously known systems. In a first aspect, the invention provides, apparatus for loading carton blanks into a packing machine, comprising:

a magazine for the supply of a succession of said carton blanks in a flat state;

a conveyor having at least one blank receiving pocket moveable in a continuous path; and transfer means for withdrawing blanks from said magazine and transferring each blank in a flat state to the or a respective pocket of said conveyor as said pocket moves along said path;

wherein said transfer means is adapted and arranged to move each said blank toward its said pocket in generally the direction in which said pocket is moving but at a velocity having a component in said path direction sufficiently greater than the speed at which said pocket moves along said path that said blank enters said pocket.

Preferably, the pocket opening through which the blank is introduced faces away from the direction of pocket movement. The transfer means may comprise means driving said blanks for said movement at said velocity which allows the said blank to be decelerated by engagement in said pocket without damage to the blank. For this purpose said blank driving means may comprise a drive member acting in use on said blanks to drive them into said pocket or pockets, which drive member is driven via means adapted to slip or is itself adapted to slip on said blanks in response to resistance to further movement of said blank at said velocity when said blank is fully home in said pocket.

Having provided means to introduce the blanks into these respective pockets in a flat state, it is now possible to open the blanks as they travel in the pockets. Accordingly, in a second aspect the present invention provides apparatus for erecting tubular carton blanks comprising:

a magazine for the supply of a succession of said carton blanks in a flat state, a conveyor having at least one blank receiving pocket, transfer means for withdrawing blanks from said magazine and transferring each blank in a flat state to the or a respective pocket of said conveyor, and opening means mounted to travel with the or each said pocket of said conveyor and serving to open a said blank in said pocket into a tubular state.

Preferably, said transfer means comprises a drive member acting in use on said blanks to drive them into said pocket or pockets, which drive member is driven via drive means at a speed in excess of that sufficient to transfer a said blank to said conveyor and said drive means is adapted to slip in response to resistance to further movement of said blank when said blank is fully home in its said conveyor pocket.

Said drive means may be a drive wheel or drive belt and may comprise an easy slipping clutch connecting means urging rotation of said wheel or belt to said wheel or belt.

Said opening means may comprise:

a first suction head for holding a first panel of a said blank and a second suction head for holding a second panel of a said blank, means mounting said first and second suction heads for movement with their said conveyor pocket, and means for producing movement of at least said second suction head for movement with respect to said conveyor pocket and away from said first suction head so as to open out a said blank in said pocket held by said first and second suction heads.

The suction heads should engage on panels which are overlying one another so that the carton blank can be opened by pulling these panels away from one another.

Each of said first and second suction heads is preferably connected to a respective cam follower which cooperates with a fixed cam to produce said blank opening movement of said suction heads with respect to their said conveyor pocket.

Each said pocket of the said conveyor is preferably provided in a transport holder which is detachable from the conveyor with an opened blank therein.

Preferably, each said transport holder comprises a magnetically attractable portion and said conveyor comprises a magnet holding said transport holder on said conveyor by attraction of said magnetically attractable portion.

Each said transport holder preferably comprises a second magnetically attractable portion facing radially outward from said conveyor by which the transport holder may be attracted out of said conveyor.

In an alternative aspect the invention provides apparatus for packing cartons comprising:

a magazine for the supply of a succession of said carton blanks in a flat state, a conveyor having at least one blank receiving pocket, transfer means for withdrawing blanks from said magazine and transferring each blank in a flat state to the or a respective pocket of said conveyor, and opening means mounted to travel with the or each said pocket of said conveyor and serving to open a said blank in said pocket into a tubular state, means for forming bottom closures on said carton whilst in said pockets, means for filling said cartons whilst in said pockets, and means for forming top closures on said cartons whilst in said pockets.

BRIEF DESCRIPTION OF THE SEVERAL VIEWS OF THE DRAWINGS

The invention will be further described and illustrated with reference to the preferred embodiment illustrated in the accompanying drawings in which.

DETAILED DESCRIPTION OF THE INVENTION

Figure 1:
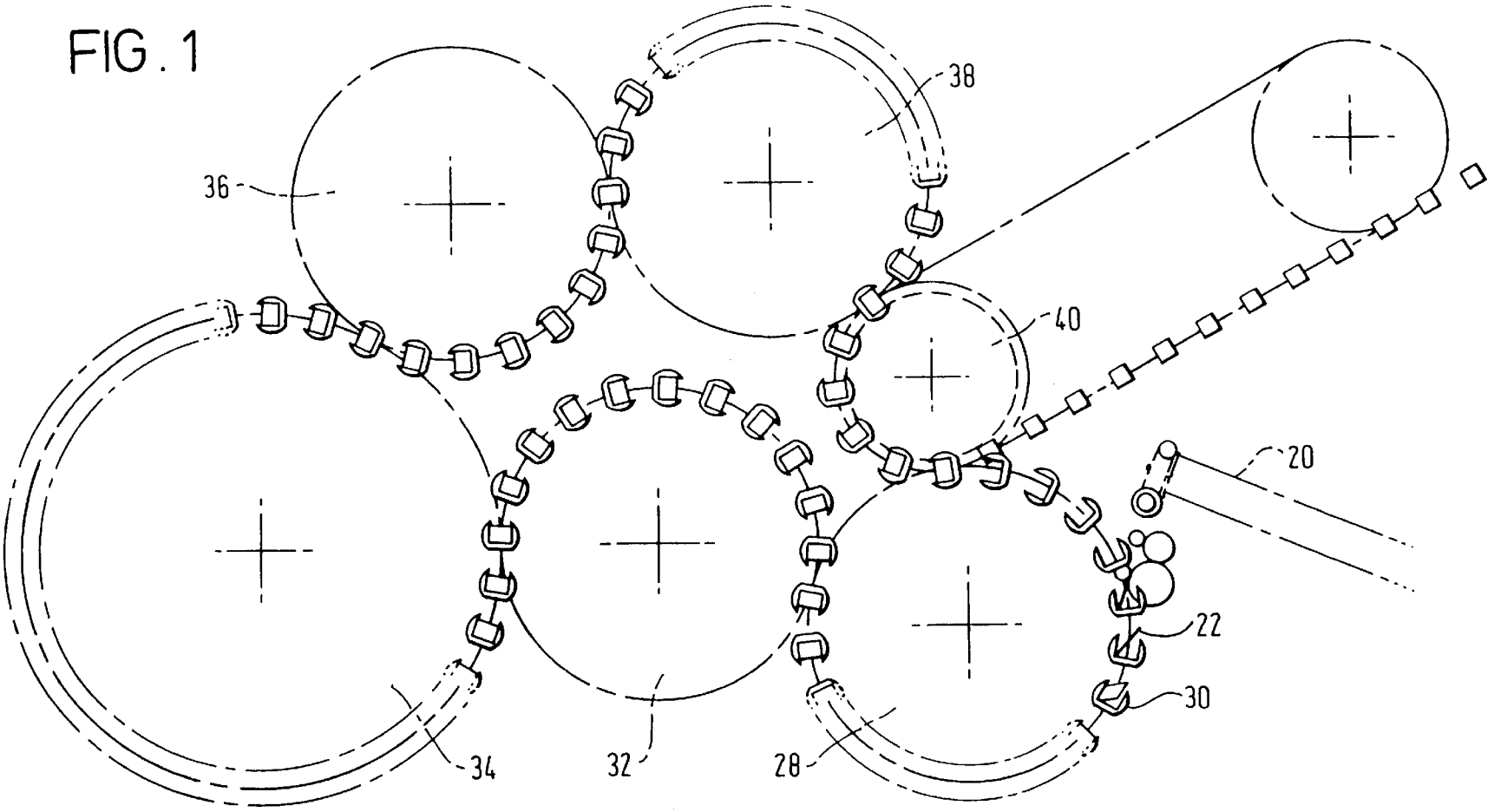
FIG. 1 is a schematic plan view of packing apparatus for filling liquid into cartons and sealing the cartons to form sealed liquid containing packs.

The apparatus shown in FIG. 1 is similar in most respects to that shown in our co-pending PCT Patent Application No. GB94/01511. The apparatus comprises a sequence of wheel conveyors around which a multitude of transport holders are conveyed in a closed cycle. Each transport holder receives a carton blank at the commencement of its cycle of movement around the apparatus and as the transport holder with its carton blank moves through the apparatus the carton blank is subjected to bottom sealing, filling and top sealing operations before being removed from its transport holder and taken out of the apparatus as a filled package. The present invention is concerned with the loading of the carton blanks into the first of the wheel conveyors. Accordingly, the operation of the apparatus shown in FIG. 1 will not be described here in detail. The general scheme of operation of the apparatus however is as follows.

Flattened tubular carton blanks 22 are held in a magazine 20 from which they are withdrawn at the mouth 24 of the magazine by a mechanism 26 described in greater detail below with reference to FIGS. 2 to 4. The flattened carton blanks are loaded on to a first conveyor wheel 28 having twenty (or sixteen in an alternative embodiment not shown) stations each of which contains a transport holder 30 described in detail below. Each transport holder is held in a recess at its station on the wheel 28 by a respective magnet. During the rotation of the wheel 28, each blank is opened from a flattened to an opened tubular form by a mechanism described in detail hereafter with reference to FIGS. 6 to 9. Wheel 28 runs tangentially alongside a second wheel 32 also having twenty (or sixteen in the alternative embodiment 20) stations. As each transport holder 30, comes into the nip between the two wheels 28 and 32, it is transferred to the wheel 32. Each station on wheel 32 has a magnet for retaining a transport holder 30 similar in strength to the magnet in the corresponding station of wheel 28. At the desired instant of transfer, the magnet of wheel 28 is retracted by a cam leaving the transport holder held on the magnet of wheel 32. During the passage of the transport holders around wheel 32, the bottom of the carton blank is sealed so as to form a bottom sealed package with an open top. The transport holders are then transferred to a third wheel 34 of thirty stations by a similar magnetic transfer operation to that described above.

During their passage around wheel 34, the cartons are filled with contents, suitably liquid contents. By a similar magnetic transfer operation, the transport holders are transferred to a twenty (or sixteen in the alternative embodiment) station wheel 36 and from there to a twenty (or sixteen in the alternative embodiment) station wheel 38. During their passage around wheel 38, a top seal is formed closing the cartons. The transport holders are then transferred by a similar magnetic transfer operation to a twelve (or in the alternative embodiment twenty) station wheel 40. During the passage of the cartons around wheel 40, they are discharged downwardly out of their transport holders on to a suitable conveyor 42 and the transport holders themselves are transferred by a magnetic transfer operation back on to the first wheel 28 where they are ready to receive a fresh carton blank.

Figure 2:
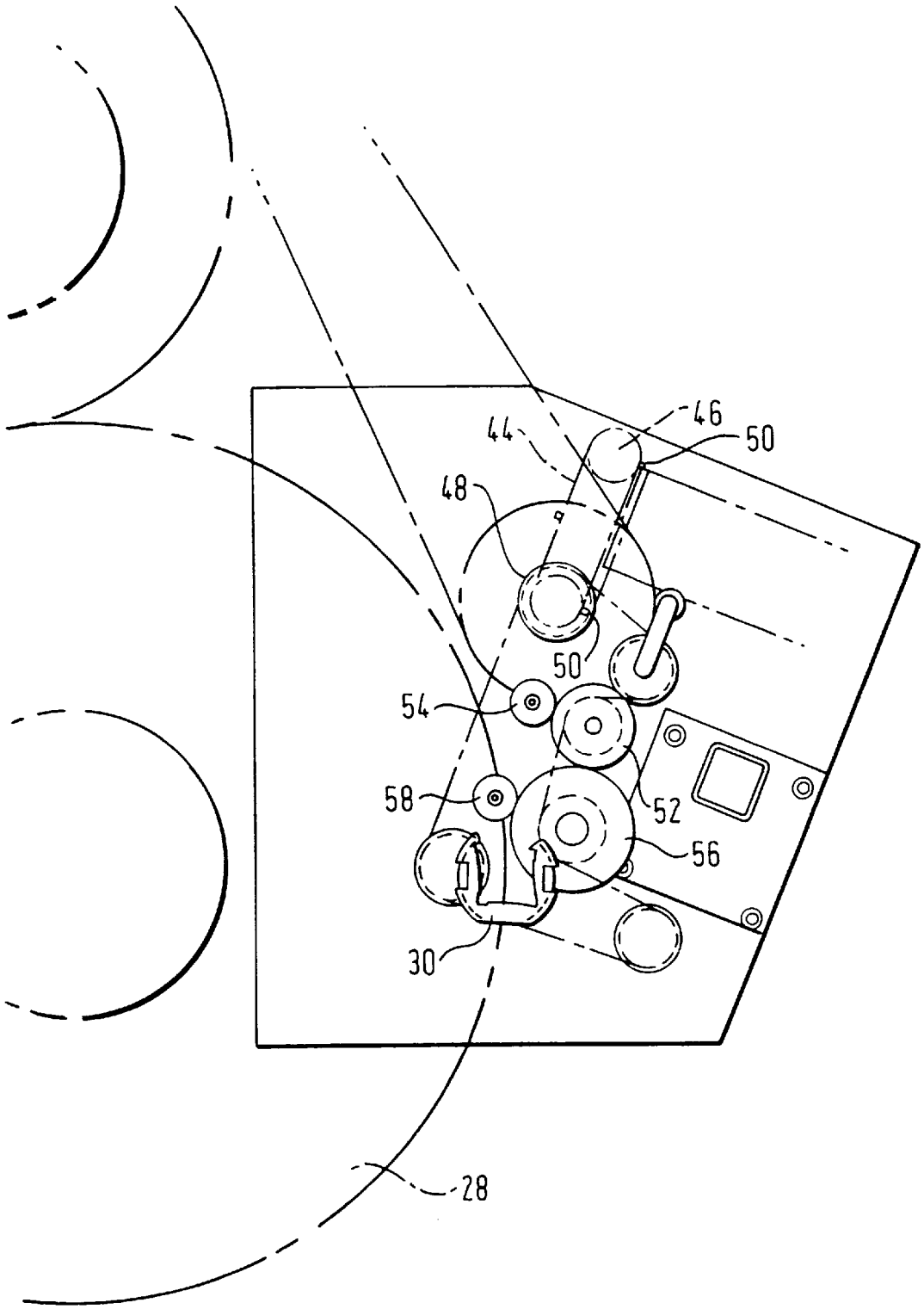
FIG. 2 is a similar view showing in greater detail the right hand half of FIG. 1, particularly the mechanism for loading blanks from a magazine onto a first conveyor.
Figure 3:
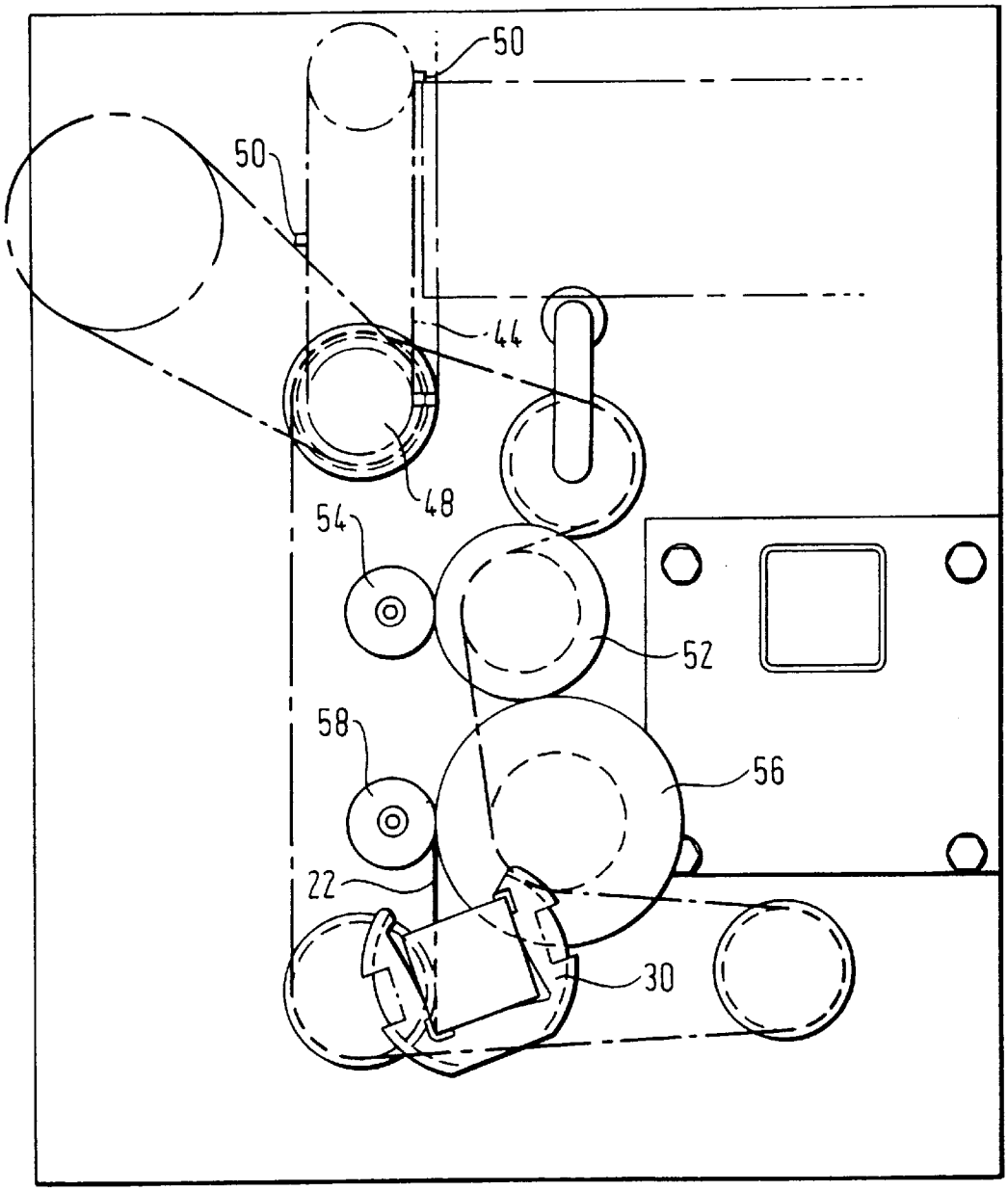
FIG. 3 is an enlarged view of the carton blank feeding components of FIG. 2.
Figure 6:
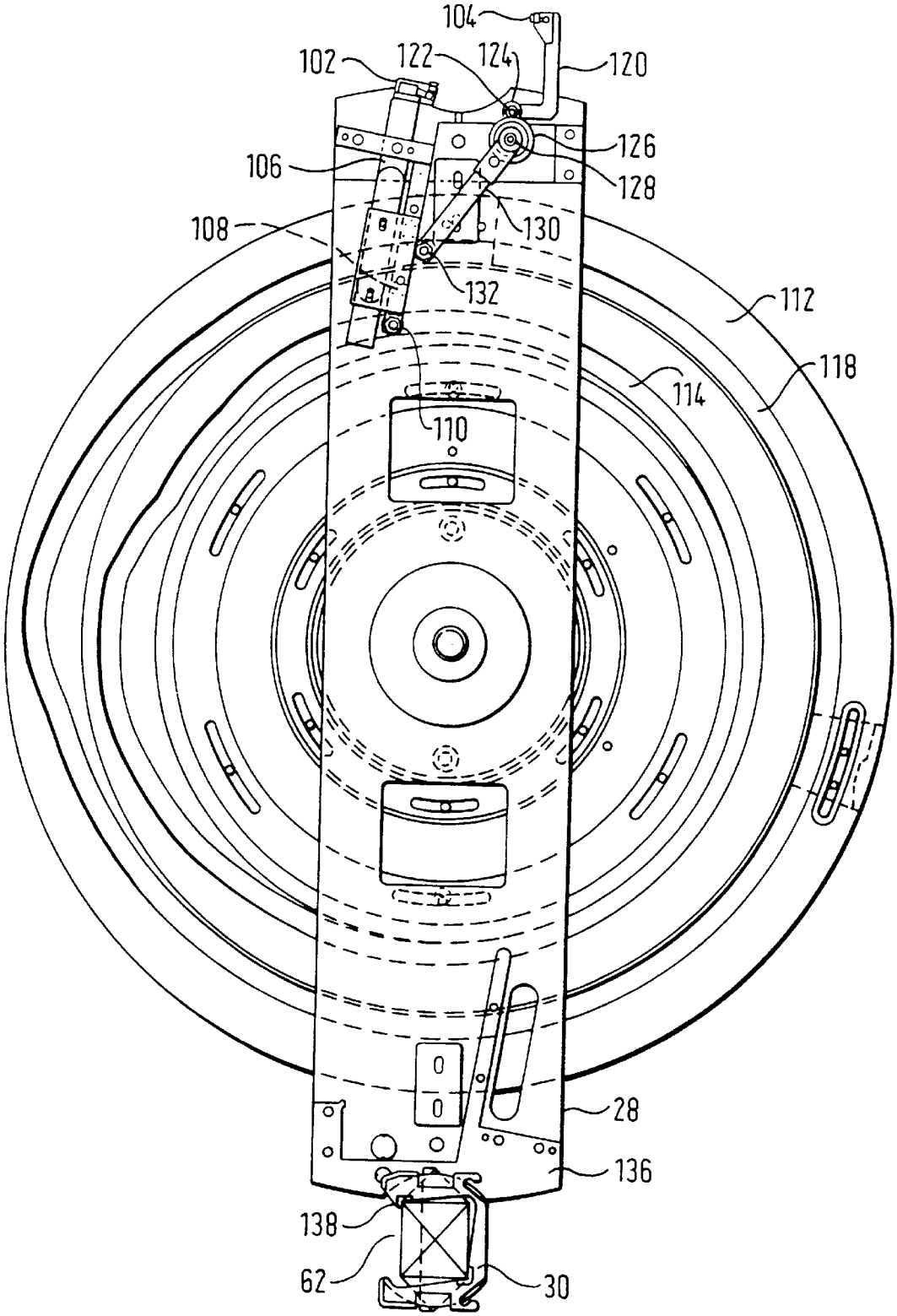
FIG. 6 is a plan view of the conveyor shown in FIG. 5.
Figure 7:
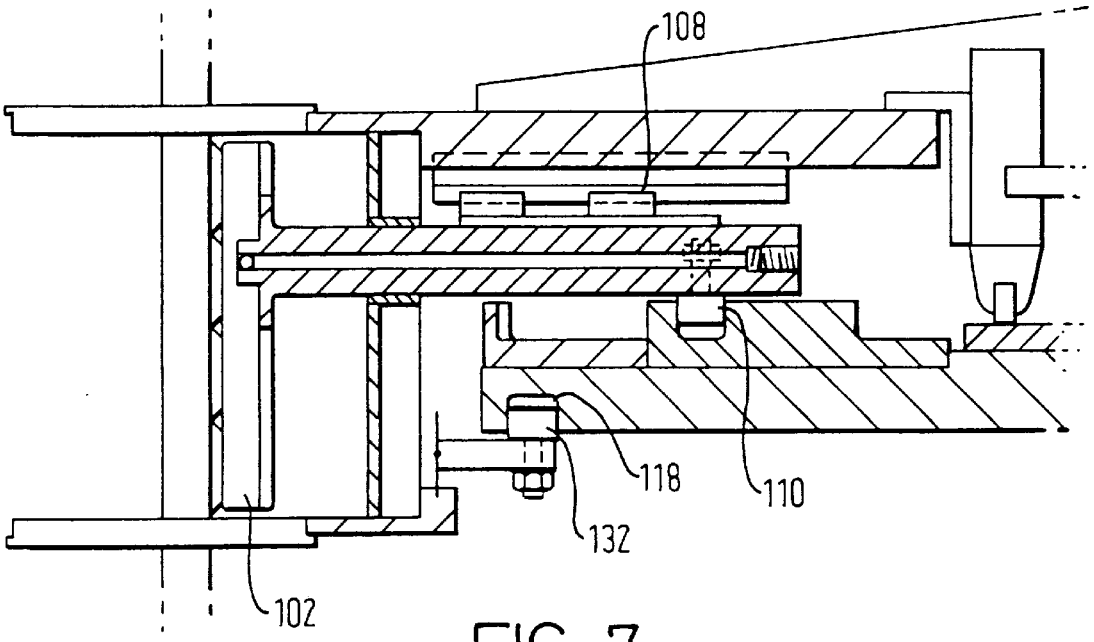
FIG. 7 is a view as in FIG. 5, but with parts omitted more clearly to show a first suction head of the illustrated station of the conveyor.
Figure 8:
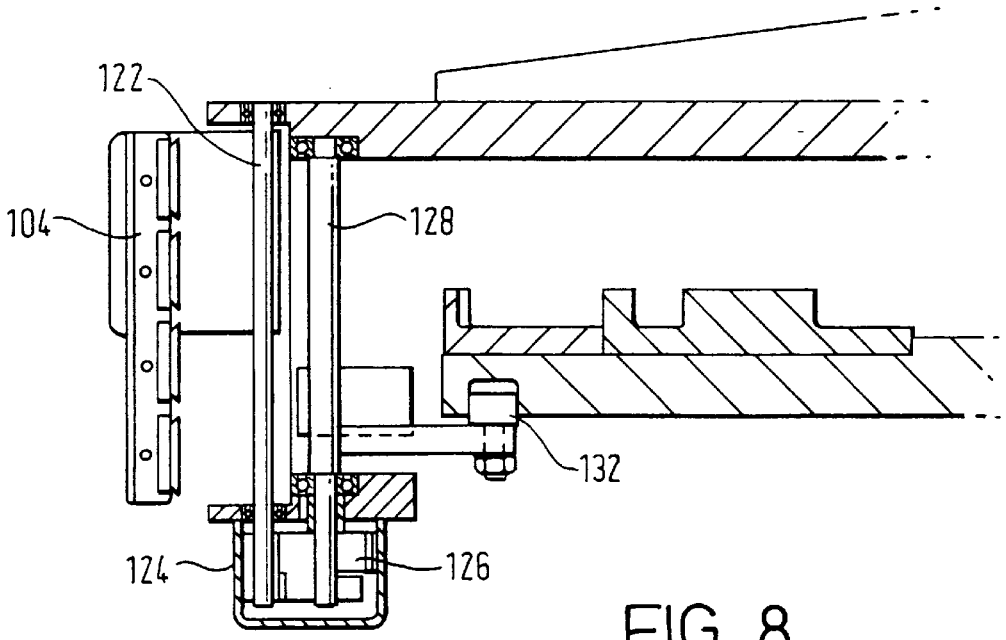
FIG. 8 is a view as in FIG. 7, but with other parts omitted more clearly to show a second suction head of the illustrated station of the conveyor.

As shown in FIG. 2, the mechanism 26 for unloading blanks from the magazine and loading them into the transport holders 30 comprises a dog-chain 44 running around sprockets 46, 48 and having at spaced intervals protruding dogs 50 positioned to catch the rear edge of a folded blank in the magazine mouth and to displace the blank sideways out of the magazine mouth through a metering aperture into the nip of a pair of rollers 52, 54. Roller 52 is a driven roller and roller 54 is an idler. Before the rear edge of each blank passes out of the nip of the rollers 52, 54, the leading edge comes into the nip of the next pair of rollers constituted by a driven roller 56 described in detail hereafter and an idler roller 58. These drive the blank so that its leading edge is driven into the corner of a respective transport holder 30 held on the first wheel 28. As is shown in FIGS. 3 and 6, each transport holder comprises a generally c-shaped top plate 60 having an opening 62, a similarly shaped bottom plate 64, and front and rear connecting bars 66, 68 which connect the top plates 60 and the bottom plates 64. The connecting bars 66, 68 are made of magnetically attractable material such as steel.

Figure 4:
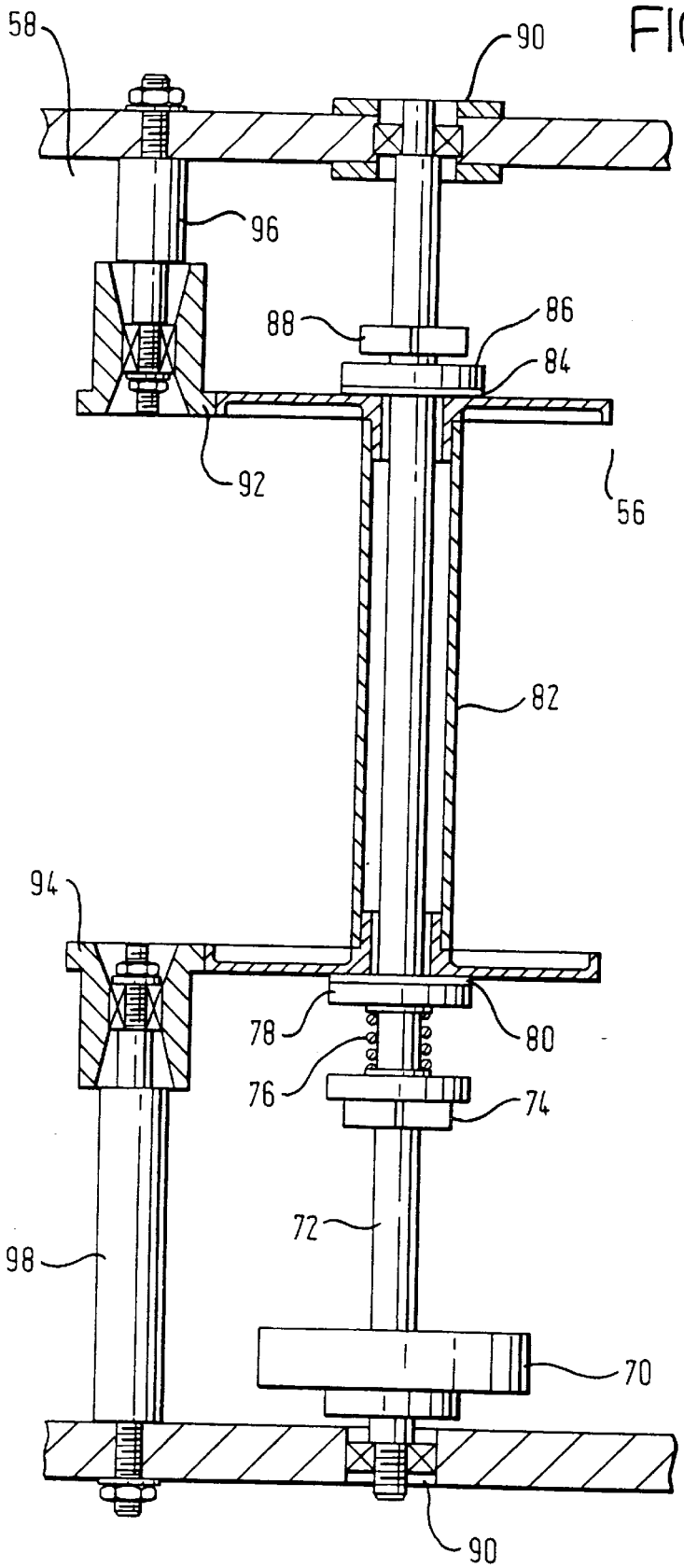
FIG. 4 is a side elevation showing an overdriven slipping drive for conveying carton blanks to the first conveyor in the apparatus of FIG. 1.
Figure 5:
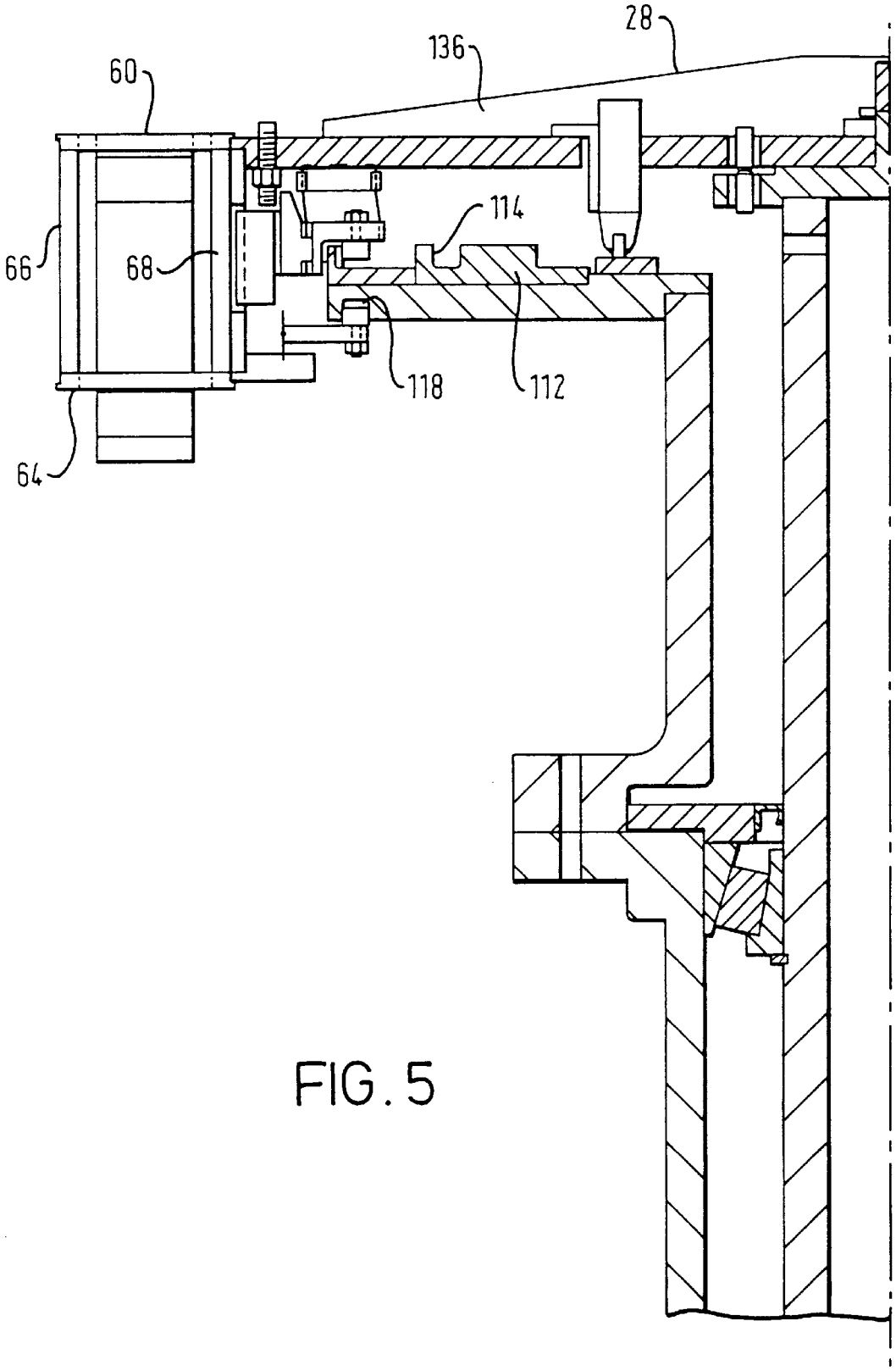
FIG. 5 is a side elevation of a portion of the first conveyor of the apparatus of FIG. 1.

Rollers 56, 58 are shown in detail in FIG. 4. Roller 56 is driven by an oversize sprocket 70 which is sized deliberately smaller than the size appropriate to drive the periphery of the roller 56 at just the right speed to bring each blank into each transport holder 30 as the wheel 28 rotates away from the roller 56. Sprocket 70 is splined to a shaft 72 carrying a height adjustable collar 74 which serves to compress a helical coil spring 76 against a thrust washer 78 which bears against a felt pad 80 which in turn rubs against the bottom of a bobbin 82 which is supported on but is free to rotate with respect to the shaft 72. At the other end of the bobbin 82 there is a similar arrangement of a second felt pad 84 backed by a thrust washer 86 held in vertical position by an adjustable collar 88. The whole assembly constituting the roller 56 is mounted for rotation in bearings 90 held in the framework of the apparatus. Roller 58 is constituted by two roller units 92, 94 each mounted for rotation on a respective stub axle 96, 98 mounted to the framework of the apparatus. In use, when a blank enters the nip between the driven roller 56 and idler roller 58, it is driven, by virtue of the undersize sprocket 70, at a rate which is sufficiently fast to guarantee that its leading edge will enter the cavity 62 of its respective transport holder and make contact with the far corner of the cavity 62. Once such contact is made, the motion of the blank will be slowed to the speed dictated by the speed of rotation of the wheel 28. To accommodate this, the felt pads 80, 84 above and below the bobbin 82 of roller 56 allow the bobbin 82 to commence slipping with respect to the shaft 72. The bobbin 82 has low inertia and therefore rapidly regains the speed of the shaft 72 once the blank has been carried out of the nip of the rollers 56, 58 by rotation of the wheel 28.

The chain 44 is driven in synchrony with the wheel 28 so as to separate each blank from the stack at the exact time appropriate to feeding the blank into the transport holder 30 which receives it. Transfer to the rollers 56, 58 running, at least for a short period before transfer of the blank to the transport holder, at a speed greater than the machine speed, ensures that any minor timing variations are compensated for. The excess speed is compensated for by slipping of the felt pads once the blank is in the transport holder.

In FIG. 6 two stations of the wheel 28 are shown and positions of the wheel 28 either side of a central portion joining the two stations are omitted. Each station of the wheel 28 comprises a magnet holding the transport holder 30 and comprises a first suction head 102 and a second suction head 104 connected to controlled vacuum lines. Each of the first and second suction heads 102, 104 is mounted for movement to produce opening of the blank. First suction head 102 is connected to an arm 106 which is mounted for linear movement by linear bearings 108. This linear movement is guided by a cam follower 110 which is moved to produce the desired movement of the first suction head 102. This movement is controlled by a fixed cam 112 which has a number of generally circular cam tracks 114, 116 and 118 which deviate from a true circular path to produce the required movement of their respective cam followers as described below.

Cam follower 110 is situated in track 114 on the upper surface of the circular plate 112 which remains stationary while the wheel 28 rotates.

The second suction head 104 is mounted on an arm 120 which pivots about an axis defined by a shaft 122 at which it is provided with a gear pinion 124 meshing with a larger pinion 126 which is provided at a pivot axis defined by a shaft 128 of an arm 130 pivoted at one end at the shaft 128 and bearing a cam follower 132 at its opposite free end. Cam follower 132 runs in cam track 118 of the stationary cam plate 112. The cam plate 112 guides the cam follower 132 to produce rotation of the pinion 126 which in turn provides rotation of the pinion 124 and hence rotation through a larger angle of rotation of the arm 120 bearing the second suction head 104. The cam tracks 114 and 118 are so shaped however that before the suction heads are moved apart as described above, they are first in a separated condition to allow a blank to feed in between them. They are then moved together to seat them on opposite sides of the blank and then they are moved apart as described. The cycle is shown in FIG. 9.

The linear bearings 108 and the shafts 112 and 128 are all mounted to a top plate 136 of the wheel 28 which rotates above the cam plate 112.

Figure 9:
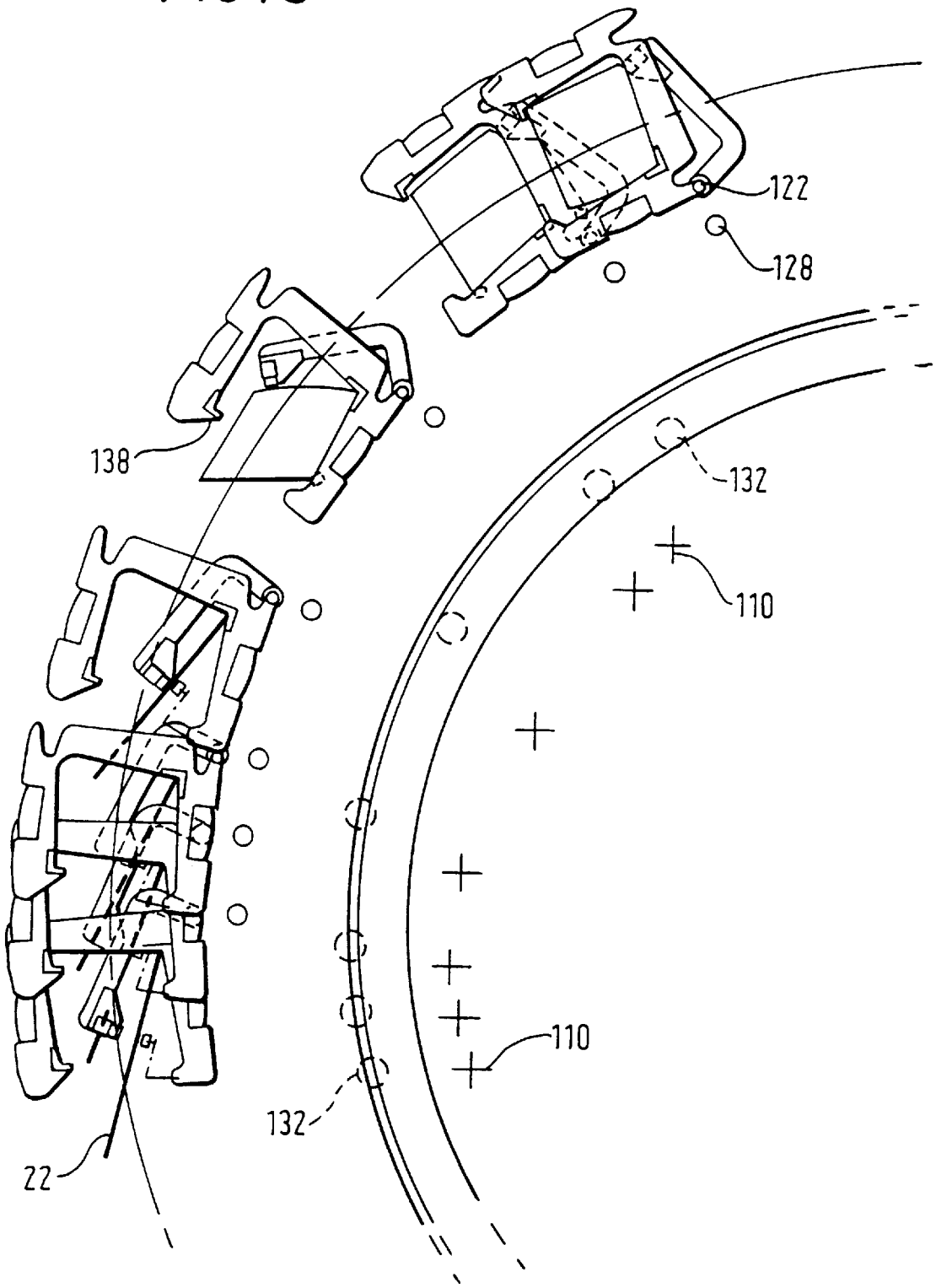
FIG. 9 shows progressive stages in the movement of the first and second suction heads shown in FIGS. 6 to 8 in opening a carton blank.

In use, a carton blank is injected into the cavity 62 of the transport holder 30 in flattened form and abuts against the radially inner rear leading corner of the cavity 62 as shown in FIG. 9. It is grasped by the first suction head 102. The second suction head 104 is brought under the influence of its cam follower 132 to grasp the opposite face of the flattened blank. Further rotation of the wheel 28 with respect to the cam plate 112 produces the movements shown in FIG. 9 in which the first suction head 102 retreats by a small distance whilst the second suction head 104 makes an anti-clockwise angular movement of much greater extent pulling the blank open to a fully rectangular shape shown in FIG. 9 (extreme clockwise position) at which time the outer corner crease of the blank latches under a projection 138 present at the entry into the cavity 62 both in the top plate 60 and in the bottom plate 64 of the transport holder 30 so that the blank is held in its fully opened position.

Many variations and modifications of the apparatus described above with reference to the accompanying drawings are possible within the scope of the invention. Thus, the blank receiving pockets constituted by transport holders 30 of the conveyor constituted by wheel 28 need not be detachable from the wheel 28 but can be fixed parts of the wheel 28 from which the erected carton blanks are removed by other means.

The slipping provided by the felt pads 80, 84 could alternatively be provided between the drive member (driven roller 56) and the blank, e.g. by arranging for the drive member to contact the blank only lightly. Alternatively, instead of providing slippage, the blanks could be driven by a variable speed drive such as a stepper motor time to slow to the appropriate extent as each blank reaches its fully home position in its respective pocket.

We claim:

1. Apparatus for loading carton blanks into a packing machine, comprising:

a magazine supplying a succession of said carton blanks in a flat state;

a conveyor having at least one blank receiving pocket moveable in a continuous path; and transfer means for withdrawing blanks from said magazine and transferring each blank in a flat state to a respective blank receiving pocket, wherein said transfer means moves each blank toward its said pocket in generally the direction in which said pocket is moving but at a velocity having a component in said direction sufficiently greater than the speed at which said pocket moves along said path.

2. Apparatus as claimed in claim 1, wherein said transfer means comprises means driving said blanks at said velocity which means allows each said blank to be decelerated by engagement in said pocket without damage to the blank.

3. Apparatus as claimed in claim 2, wherein said blank driving means comprises a drive member acting on said blanks to drive them into said pockets, which drive member is driven via means adapted to slip on said blanks in response to resistance to further movement of said blank when said blank is fully engaged in said pocket.

4. Apparatus for erecting tubular carton blanks, comprising:

a magazine supplying a succession of said carton blanks in a flat state;

a conveyor having at least one blank receiving pocket;

transfer means for withdrawing blanks from said magazine and transferring each blank in a flat state to a respective pocket; and opening means mounted to travel with each said pocket for opening said blank in said pocket into a tubular state.

5. Apparatus as claimed in claim 4, wherein said transfer means comprises a drive member acting on said blanks to drive them into said pockets, said drive member being driven via drive means at a speed in excess of that sufficient to transfer said blank to said conveyor and said drive means being adapted to slip in response to resistance to further movement of said blank when said blank fully engages its said conveyor pocket.

6. Apparatus as claimed in claim 5, wherein said drive means is a drive wheel or drive belt and wherein said drive means comprises an easy slipping clutch connecting means urging rotation of said wheel or belt to said wheel or belt.

7. Apparatus as claimed in claim 4, wherein said opening means comprises:

a first suction head for holding a first panel of said blank and a second suction head for holding a second panel of said blank;

means mounting said first and second suction heads for movement with their associated conveyor pocket; and means for producing movement of at least said second suction head with respect to said conveyor pocket and away from said first suction head to open out said blank in said pocket.

8. Apparatus as claimed in claim 7, wherein each of said first and second suction heads is connected to a respective cam follower which cooperates with a fixed cam to open said blank in said associated conveyor pocket.

9. Apparatus as claimed in claim 4, wherein each said pocket of said conveyor is provided in a transport holder which is detachable from said conveyor with an opened blank therein.

10. Apparatus as claimed in claim 9, wherein each said transport holder comprises a magnetically attractable portion and said conveyor comprises a magnet holding said transport holder on said conveyor by attraction of said magnetically attractable portion.

11. Apparatus as claimed in claim 10, wherein each said transport holder comprises a second magnetically attractable portion facing radially outward from said conveyor by which said transport holder may be attracted out of said conveyor.

12. Apparatus for packing cartons, comprising:

a magazine supplying a succession of carton blanks in a flat state;

a conveyor having at least one blank receiving pocket;

transfer means for withdrawing said carton blanks individually from said magazine and transferring each blank in a flat state to a respective pocket;

opening means mounted to travel with each said pocket to open said blank in said pocket into a tubular state, forming a carton;

means for forming a bottom closure on said carton whilst in said pocket;

means for filling said carton while in said pocket; and means for forming a top closure on said carton while in said pocket.

13. An apparatus for loading carton blanks into a packing machine, comprising:

a magazine supplying a succession of carton blanks in a flat state;

a conveyor, moveable along a continuous path, having at least one blank receiving pocket; and a loading mechanism withdrawing the blanks from the magazine and transferring each blank in a flat state to a respective blank receiving pocket, wherein the loading mechanism transfers each blank toward its respective blank receiving pocket with a velocity, as measured along the continuous path, greater than that at which the blank receiving pockets move along the continuous path.

14. The apparatus of claim 13, wherein the loading mechanism comprises a drive member driving each blank into its respective blank receiving pocket and allowing each blank to decelerate, when the blank engages its respective blank receiving pocket, without damage to the blank.

15. The apparatus of claim 14, wherein the drive member is driven via a slip mechanism that slips on each blank when the blank resists further movement after fully engaging its respective blank receiving pocket.

16. An apparatus for erecting tubular carton blanks, comprising:

a magazine supplying a succession of the carton blanks in a flat state;

a conveyor having at least one blank receiving pocket;

a loading mechanism withdrawing the blanks from the magazine and transferring each blank to its respective blank receiving pocket in a flat state; and an opening mechanism, associated with each blank receiving pocket, opening the blank in the pocket into a tubular state.

17. The apparatus of claim 16, wherein the loading mechanism comprises a drive member to drive each blank into its respective blank receiving pocket at a speed greater than required to transfer each blank to the conveyor, the drive member being driven via a slip mechanism that slips on each blank when the blank resists further movement after fully engaging its respective blank receiving pocket.

18. The apparatus of claim 17, wherein the drive member comprises a drive wheel or drive belt and the slip mechanism comprises an easy slipping clutch connected to the drive wheel or drive belt.

19. The apparatus of claim 16, wherein the opening mechanism comprises:

a first suction head for holding a first panel of the blank;

a second suction head for holding a second panel of the blank;

a mounting mechanism movably connecting the first and second suction heads to their respective blank receiving pocket;

a moving mechanism, associated with the first and second suction heads, moving at least the second suction head away from the first suction head to open the blank into the tubular state.

20. The apparatus of claim 19, wherein the first and second suction heads are connected to a respective cam follower, which cooperates with a fixed cam to open the blank into the tubular state.

21. The apparatus of claim 16, wherein each blank receiving pocket comprises a transport holder detachable from the conveyor with an opened blank therein.

22. The apparatus of claim 21, wherein each transport holder comprises a magnetically attractable portion and the conveyor comprises a magnet holding the transport holder on the conveyor by attraction between the magnet and the magnetically attractable portion.

23. The apparatus of claim 22, wherein each transport holder further comprises a second magnetically attractable portion, facing radially outward from the conveyor, by which the transport holder may be attracted out of the conveyor.

24. An apparatus for packing cartons, comprising:

a magazine supplying a succession of carton blanks in a flat state;

a conveyor having at least one blank receiving pocket;

a loading mechanism withdrawing the carton blanks from the magazine and transferring each blank to respective blank receiving pocket;

an opening mechanism associated with each of the blank receiving pockets opening the associated blank into a tubular state, forming a carton;

a bottom closure mechanism for forming a bottom closure on each carton while in its respective pocket;

a filling mechanism for filling each carton while in its respective pocket; and a top closure mechanism for forming a top closure on each carton while in its respective pocket.

* * * * *